US009915066B2

(12) United States Patent
Hoshino et al.

(10) Patent No.: US 9,915,066 B2
(45) Date of Patent: Mar. 13, 2018

(54) SOUND ABSORBING PANEL AND SOUNDPROOF WALL EQUIPMENT

(71) Applicant: NIPPON SHEET GLASS ENVIRONMENT AMENITY CO., LTD., Tokyo (JP)

(72) Inventors: Yasushi Hoshino, Tokyo (JP); Masakazu Kiyama, Tokyo (JP); Shimpei Yatsunami, Tokyo (JP); Junichi Fukito, Tokyo (JP)

(73) Assignee: NIPPON SHEET GLASS ENVIRONMENT AMENITY CO., LTD., Tokyo (JP)

( * ) Notice: Subject to any disclaimer, the term of this patent is extended or adjusted under 35 U.S.C. 154(b) by 0 days.

(21) Appl. No.: 15/115,214

(22) PCT Filed: Nov. 27, 2014

(86) PCT No.: PCT/JP2014/081399
§ 371 (c)(1),
(2) Date: Jul. 28, 2016

(87) PCT Pub. No.: WO2015/114929
PCT Pub. Date: Aug. 6, 2015

(65) Prior Publication Data

US 2016/0340896 A1 Nov. 24, 2016

(30) Foreign Application Priority Data

Jan. 28, 2014 (JP) ..... 2014-012937

(51) Int. Cl.
*E04B 1/82* (2006.01)
*E01F 8/00* (2006.01)
(Continued)

(52) U.S. Cl.
CPC ..... *E04B 1/8209* (2013.01); *E01F 8/0005* (2013.01); *G10K 11/162* (2013.01); *G10K 11/18* (2013.01); *E04B 2001/8461* (2013.01)

(58) Field of Classification Search
CPC ..... E04B 1/8209; E04B 2001/8461; G10K 11/162; G10K 11/18; E01F 8/0005; E01F 8/007
See application file for complete search history.

(56) References Cited

U.S. PATENT DOCUMENTS 3,656,576 A * 4/1972 Gubela ..... E01F 8/007 181/210
3,804,196 A * 4/1974 Horn ..... E01F 8/007 181/285
(Continued)

FOREIGN PATENT DOCUMENTS

JP 51086011 U * 7/1976
JP S61-002516 U 1/1986
(Continued)

OTHER PUBLICATIONS

International Search Report issued in Application No. PCT/JP2014/081399, mailed Feb. 24, 2015.
(Continued)

*Primary Examiner* — Rodney Mintz
(74) *Attorney, Agent, or Firm* — Michael Best & Friedrich LLP

(57) ABSTRACT

A sound absorbing panel is provided above an uppermost of soundproof panels arranged in plural stages in a vertical direction and each having a back surface opposite to a sound source side, the back surface being formed to be a sound insulating surface, the sound absorbing panel including: an outer frame body having therein an acoustic space in which a first acoustic material is provided, the outer frame body allowing formation of a partition wall separating a sound
(Continued)

source and a surrounding area from each other, the outer frame body having, at a front and back portions thereof, sound transmitting surfaces each having multiple sound through holes allowing transfer of sound between the acoustic space and outside thereof; and a second acoustic material provided above an upper end of the outer frame body such that a peripheral surface of the second acoustic material except for a corner portion is air-permeable.

12 Claims, 18 Drawing Sheets

(51) Int. Cl.

| | |
|---|---|
| ***G10K 11/18*** | (2006.01) |
| ***G10K 11/162*** | (2006.01) |
| *E04B 1/84* | (2006.01) |

(56) References Cited

U.S. PATENT DOCUMENTS

| | | | | | |
|---|---|---|---|---|---|
| 3,846,949 | A * | 11/1974 | Okawa | E01F 8/007 | 181/285 |
| 4,042,061 | A * | 8/1977 | Murakami | E01F 8/007 | 181/210 |
| 4,899,846 | A | 2/1990 | Furuta et al. | | |
| 5,009,043 | A * | 4/1991 | Kurrasch | E04B 1/8227 | 181/290 |
| 5,060,752 | A * | 10/1991 | Heiberger | E04B 1/8218 | 181/200 |
| 7,412,801 | B2 * | 8/2008 | Papakonstantinou | E04B 1/8227 | 181/290 |
| 2007/0125010 | A1 * | 6/2007 | Papakonstantinou | E04B 1/8227 | 52/144 |
| 2011/0186380 | A1 * | 8/2011 | Beauvilain | B60R 13/08 | 181/292 |
| 2013/0264147 | A1 * | 10/2013 | Sugimoto | B61D 17/185 | 181/292 |
| 2014/0137495 | A1 * | 5/2014 | Ariza | E04B 2/827 | 52/238.1 |
| 2014/0286695 | A1 * | 9/2014 | Jocham | H02B 1/30 | 403/205 |
| 2015/0345131 | A9 * | 12/2015 | Ariza | E04B 2/827 | 52/238.1 |
| 2016/0376788 | A1 * | 12/2016 | Duran Ariza | E04B 2/827 | 52/64 |

FOREIGN PATENT DOCUMENTS

| | | | | |
|---|---|---|---|---|
| JP | S62-186200 | U | | 11/1987 |
| JP | H07-300822 | A | | 11/1995 |
| JP | 2000-144651 | A | | 5/2000 |
| JP | 2002-266322 | A | | 9/2002 |
| JP | 2005-030116 | A | | 2/2005 |
| JP | 2008111307 | A | * | 5/2008 |
| JP | 2014-101747 | A | | 6/2014 |
| JP | 2015224469 | A | * | 12/2015 |
| KR | 20-0245939 | B1 | | 10/2005 |
| KR | 10-2013-0002014 | U | | 3/2013 |
| KR | 10-2013-0142150 | A | | 12/2013 |
| SG | 192056 | A1 | | 8/2013 |
| WO | WO-2012/102278 | A1 | | 8/2012 |

OTHER PUBLICATIONS

International Preliminary Report on Patentability issued in Application No. PCT/JP2014/081399.

Office Action issued in Korean Application No. 10-2016-7020621 dated Jan. 31, 2017.

* cited by examiner

SOUND ABSORBING PANEL AND SOUNDPROOF WALL EQUIPMENT

TECHNICAL FIELD

The present invention relates to: a sound absorbing panel provided further above the uppermost one of soundproof panels arranged in plural stages in the vertical direction and each having a back surface opposite to the sound source side, the back surface being formed to be a sound insulating surface, in soundproof wall equipment having the soundproof panels arranged in plural stages in the vertical direction; and soundproof wall equipment using the sound absorbing panel.

BACKGROUND ART

Conventionally, in general, soundproof wall equipment merely has the soundproof panels arranged in plural stages in the vertical direction, and acoustic materials provided in the acoustic spaces of these soundproof panels are materials having the same acoustic performance with a constant surface density. A sound-source-side front surface portion of each soundproof panel is formed to be a sound transmitting surface, while each soundproof panel has, on the back surface side thereof, a sound insulating surface formed of a rigid plate, to achieve a sound insulating wall function (for example, see Patent Literature 1).

Therefore, there is a great sound pressure difference between the sound source side and the back surface side of the soundproof panels arranged in the vertical direction, and in the vicinity of the upper end edge of the soundproof wall equipment, the energy of accelerated sound (this is referred to as "edge effect") causes a diffraction phenomenon, resulting in a problem that the diffracted sound spreads toward the residential area on the back surface side of the soundproof wall equipment.

Accordingly, in order to solve the above problem, technology referred to as "edge effect suppression technology" is proposed in which a sound absorbing panel having sound transmitting surfaces formed in a sound-source-side front surface portion and a back surface portion is provided further above the uppermost one of the soundproof panels arranged in plural stages in the vertical direction, thereby enabling reduction in the diffraction sound that is to be diffracted in the vicinity of the upper end edge of the uppermost one of the soundproof panels arranged in plural stages in the vertical direction (for example, see Patent Literature 2).

CITATION LIST

Patent Literature

[PTL 1] Japanese Laid-Open Patent Publication No. H07-300822

[PTL 2] International Publication No. 2012/102278

SUMMARY OF THE INVENTION

Problems to be Solved by the Invention

In the above proposal, in providing the sound absorbing panel above the soundproof panel, it is difficult to provide an acoustic material alone as the sound absorbing panel, and for the purpose of protecting the acoustic material from an external force received from wind or the like, it is necessary to provide an outer frame body formed of a metal plate, having therein an acoustic space in which the acoustic material is provided, and allowing formation of a partition wall separating a sound source and an area around the sound source from each other, and fix the outer frame body to a pole for supporting the soundproof panels, the soundproof panel, or the like.

However, even if sound transmitting surfaces having multiple sound through holes which allow transfer of sound between the acoustic space and outside thereof are formed in the sound-source-side front surface portion and the back surface portion of the outer frame body, an effect of reducing low-frequency sound is expected owing to the acoustic material but an effect of reducing high-frequency sound is lower than in the case of providing the acoustic material alone.

Therefore, an object of the present invention is to solve the above problem, and enable reduction in, as well as low-frequency sound, high-frequency sound of diffraction sound that is to be diffracted in the vicinity of the upper end edge of the uppermost one of the soundproof panels.

Solution to the Problems

The present inventor has made the present invention on the basis of the following new findings. That is, air-permeability is not ensured at a corner of an upper surface of an outer frame body composing the sound absorbing panel, and thus edge effect suppression performance decreases in a frequency band of, in particular, 1 KHz or higher. An acoustic material exhibits a high acoustic effect for high-frequency sound if the acoustic material has no part shielded by a hard frame body or the like and air-permeability is ensured over the whole peripheral surface. The first aspect of the present invention is a sound absorbing panel provided further above an uppermost one of soundproof panels arranged in plural stages in a vertical direction and each having a back surface opposite to a sound source side, the back surface being formed to be a sound insulating surface, in soundproof wall equipment having the soundproof panels arranged in plural stages in the vertical direction, the sound absorbing panel including: an outer frame body having therein an acoustic space in which a first acoustic material is provided, the outer frame body allowing formation of a partition wall separating a sound source and an area around the sound source from each other, the outer frame body having, at a sound-source-side front surface portion and a back surface portion thereof, sound transmitting surfaces each having multiple sound through holes allowing transfer of sound between the acoustic space and outside thereof; and a second acoustic material provided further above an upper end of the outer frame body, wherein a peripheral surface of the second acoustic material except for a corner portion of an upper end edge on a sound source side is covered by an air-permeable member, and a reinforcement portion is provided at the corner portion.

According to the first aspect of the present invention, the outer frame body stably supports the first acoustic material provided in the acoustic space, against vibration as well as wind, and in addition, since the sound transmitting surfaces each having multiple sound through holes which allow transfer of sound between the acoustic space and outside thereof are formed in the sound-source-side front surface portion and the back surface portion of the outer frame body, it is possible to reduce the diffraction sound that is to be diffracted in the vicinity of the upper end edge of the uppermost one of the soundproof panels arranged in plural stages in the vertical direction.

Further, the high-frequency sound of the diffraction sound, which cannot be completely reduced by the first acoustic material surrounded by the outer frame body, can be effectively absorbed and reduced by providing the second acoustic material further above the upper end portion of the outer frame body, covering the peripheral surface of the second acoustic material except for the corner portion of the upper end edge on the sound source side by an air-permeable member, and providing a reinforcement portion at the corner portion. Thus, it becomes possible to improve soundproof performance over a wide sound region as a whole.

In addition, even if an external force such as vibration or wind is exerted, it is possible to hold the second acoustic material by the reinforcement material without deteriorating acoustic performance of the second acoustic material.

The second aspect of the present invention is a sound absorbing panel provided further above an uppermost one of soundproof panels arranged in plural stages in a vertical direction and each having a back surface opposite to a sound source side, the back surface being formed to be a sound insulating surface, in soundproof wall equipment having the soundproof panels arranged in plural stages in the vertical direction, the sound absorbing panel including: an outer frame body having therein an acoustic space in which a first acoustic material is provided, the outer frame body allowing formation of a partition wall separating a sound source and an area around the sound source from each other, the outer frame body having, at a sound-source-side front surface portion and a back surface portion thereof, sound transmitting surfaces each having multiple sound through holes allowing transfer of sound between the acoustic space and outside thereof, the outer frame body having reinforcement portions at corner portions of sound-source-side and back-surface-side upper end edges thereof; and a second acoustic material provided further above an upper end of the outer frame body, wherein a peripheral surface of the second acoustic material is covered by an air-permeable member.

According to the second aspect of the present invention, the outer frame body stably supports the first acoustic material provided in the acoustic space, against vibration as well as wind, and in addition, since the sound transmitting surfaces each having multiple sound through holes which allow transfer of sound between the acoustic space and outside thereof are formed in the sound-source-side front surface portion and the back surface portion of the outer frame body, it is possible to reduce the diffraction sound that is to be diffracted in the vicinity of the upper end edge of the uppermost one of the soundproof panels arranged in plural stages in the vertical direction.

The outer frame body has the reinforcement portions at the corner portions of the sound-source-side and back-surface-side upper end edges thereof, and further, the high-frequency sound of the diffraction sound, which cannot be completely reduced by the first acoustic material surrounded by the outer frame body, can be effectively absorbed and reduced by providing the second acoustic material further above the upper end portion of the outer frame body, and covering the peripheral surface of the second acoustic material by an air-permeable member. Thus, it becomes possible to improve soundproof performance over a wide sound region as a whole.

The third aspect of the present invention is a sound absorbing panel provided further above an uppermost one of soundproof panels arranged in plural stages in a vertical direction and each having a back surface opposite to a sound source side, the back surface being formed to be a sound insulating surface, in soundproof wall equipment having the soundproof panels arranged in plural stages in the vertical direction, the sound absorbing panel including: an outer frame body having therein an acoustic space in which a first acoustic material is provided, the outer frame body allowing formation of a partition wall separating a sound source and an area around the sound source from each other, the outer frame body having, at a sound-source-side front surface portion and a back surface portion thereof, sound transmitting surfaces each having multiple sound through holes allowing transfer of sound between the acoustic space and outside thereof; and a second acoustic material provided further above an upper end of the outer frame body, wherein a peripheral surface in a range of both front and back side surfaces and an upper surface of the second acoustic material except for a corner portion of an upper end edge on a sound source side is covered by an air-permeable member, a reinforcement portion is provided at the corner portion, and a lower surface portion of the second acoustic material is covered by a member with no air-permeability.

The fourth aspect of the present invention is a sound absorbing panel provided further above an uppermost one of soundproof panels arranged in plural stages in a vertical direction and each having a back surface opposite to a sound source side, the back surface being formed to be a sound insulating surface, in soundproof wall equipment having the soundproof panels arranged in plural stages in the vertical direction, the sound absorbing panel including: an outer frame body having therein an acoustic space in which a first acoustic material is provided, the outer frame body allowing formation of a partition wall separating a sound source and an area around the sound source from each other, the outer frame body having, at a sound-source-side front surface portion and a back surface portion thereof, sound transmitting surfaces each having multiple sound through holes allowing transfer of sound between the acoustic space and outside thereof, the outer frame body having reinforcement portions at corner portions of sound-source-side and back-surface-side upper end edges thereof; and a second acoustic material provided further above an upper end of the outer frame body, wherein a peripheral surface in a range of both front and back side surfaces and an upper surface of the second acoustic material is covered by an air-permeable member, and a lower surface portion of the second acoustic material is covered by a member with no air-permeability.

In the fifth aspect of the present invention, the first acoustic material and the second acoustic material are formed of a porous material made of polyester fiber wool.

In the sixth aspect of the present invention, surface densities of the first acoustic material and the second acoustic material are set at 0.6 to 100 $kg/m^2$(0.1 to 20 $lb/ft^2$), and flow resistance values thereof are set at 50 to 4000 $N \cdot s/m^3$ (10 $lb/ft^2s$ to 800 $lb/ft^2s$).

The seventh aspect of the present invention is a sound absorbing panel provided further above an uppermost one of soundproof panels arranged in plural stages in a vertical direction and each having a back surface opposite to a sound source side, the back surface being formed to be a sound insulating surface, in soundproof wall equipment having the soundproof panels arranged in plural stages in the vertical direction, the sound absorbing panel including: one panel-like acoustic material; a surface body having multiple sound through holes allowing transfer of sound between inside and outside of the panel-like acoustic material, the surface body covering a sound source side, a back surface side, and an upper portion of the panel-like acoustic material except for a corner portion of an upper end edge on a sound source side; an auxiliary reinforcement portion provided at the corner portion; an intermediate reinforcement frame body provided at an intermediate portion in the vertical direction on each of a sound source side and a back surface side of the surface body; and a lower reinforcement frame body provided at a lower portion of the surface body, wherein the intermediate reinforcement frame body and the lower reinforcement frame body form a reinforcement frame reinforcing a lower part below the intermediate portion in the vertical direction of the surface body. According to the seventh aspect of the present invention, as in the first aspect of the present invention, since the lower part below the intermediate portion of one panel-like acoustic material is reinforced by the reinforcement frame body, the lower part of the acoustic material is stably supported against vibration as well as wind, and in addition, since the sound source side, the back surface side, and the upper portion of the panel-like acoustic material except for the corner portion of the upper end edge on the sound source side are covered by the surface body having the multiple sound through holes allowing transfer of sound between inside and outside of the panel-like acoustic material, it is possible to reduce the diffraction sound that is to be diffracted in the vicinity of the upper end edge of the uppermost one of the soundproof panels arranged in plural stages in the vertical direction.

Further, the high-frequency sound of the diffraction sound, which cannot be completely reduced by the acoustic material surrounded by the reinforcement frame body, is effectively absorbed and reduced by the upper part above the intermediate portion in the vertical direction of the acoustic material provided such that at least the peripheral surface thereof except for the corner portion of the upper end edge on the sound source side is air-permeable. Thus, it becomes possible to improve soundproof performance over a wide sound region as a whole.

Even if an external force such as vibration or wind is exerted, it is possible to hold the upper part above the intermediate portion in the vertical direction of the acoustic material by the reinforcement material without deteriorating acoustic performance of the acoustic material.

The eighth aspect of the present invention is a sound absorbing panel provided further above an uppermost one of soundproof panels arranged in plural stages in a vertical direction and each having a back surface opposite to a sound source side, the back surface being formed to be a sound insulating surface, in soundproof wall equipment having the soundproof panels arranged in plural stages in the vertical direction, the sound absorbing panel including: one panel-like acoustic material; a surface body having multiple sound through holes allowing transfer of sound between inside and outside of the panel-like acoustic material, the surface body covering a sound source side, a back surface side, and an upper portion of the panel-like acoustic material; an intermediate reinforcement frame body provided at an intermediate portion in the vertical direction on each of a sound source side and a back surface side of the surface body; and a lower reinforcement frame body provided at a lower portion of the surface body, wherein the intermediate reinforcement frame body and the lower reinforcement frame body form a reinforcement frame reinforcing a lower part below the intermediate portion in the vertical direction of the surface body.

According to the eighth aspect of the present invention, as in the first aspect of the present invention, since the lower part below the intermediate portion of one panel-like acoustic material is reinforced by the reinforcement frame body, the lower part of the acoustic material is stably supported against vibration as well as wind, and in addition, since the sound source side, the back surface side, and the upper portion of the panel-like acoustic material are covered by the surface body having the multiple sound through holes allowing transfer of sound between inside and outside of the panel-like acoustic material, it is possible to reduce the diffraction sound that is to be diffracted in the vicinity of the upper end edge of the uppermost one of the soundproof panels arranged in plural stages in the vertical direction.

Further, the high-frequency sound of the diffraction sound, which cannot be completely reduced by the acoustic material surrounded by the reinforcement frame body, is effectively absorbed and reduced by the upper part above the intermediate portion in the vertical direction of the acoustic material provided such that the whole peripheral surface thereof is air-permeable. Thus, it becomes possible to improve soundproof performance over a wide sound region as a whole.

The ninth aspect of the present invention is a sound absorbing panel provided further above an uppermost one of soundproof panels arranged in plural stages in a vertical direction and each having a back surface opposite to a sound source side, the back surface being formed to be a sound insulating surface, in soundproof wall equipment having the soundproof panels arranged in plural stages in the vertical direction, the sound absorbing panel including: one panel-like acoustic material; an air-permeable member covering a whole periphery of the panel-like acoustic material; and reinforcement portions provided at a bottom portion and a corner portion of an upper end edge on a sound source side of the air-permeable member.

According to the ninth aspect of the present invention, one panel-like acoustic material is provided, the air-permeable member covers the whole periphery of the panel-like acoustic material, and the reinforcement portions are provided at the bottom portion and the corner portion of the upper end edge on the sound source side of the air-permeable member. Thus, the acoustic material is stably supported against wind and vibration, by the air-permeable member and the reinforcement portions.

Further, the high-frequency sound of the diffraction sound passing through the air-permeable member is effectively absorbed and reduced by the acoustic material without inhibition because the reinforcement portions are provided at the bottom portion and the corner portion of the upper end edge on the sound source side.

In the tenth aspect of the present invention, the acoustic material is formed of a porous material made of polyester fiber wool.

According to the tenth aspect of the present invention, since the acoustic material is formed of polyester fiber wool which is a porous material, the acoustic material can be provided with light weight and at low cost.

In the eleventh aspect of the present invention, the porous surface body is one selected from punching metal, a wire net, cloth, and a metallic sintered material.

According to the eleventh aspect of the present invention, by the porous surface body which is one selected from punching metal, a wire net, cloth, and a metallic sintered material, the acoustic material is protected so that the fiber material thereof does not scatter, whereby the acoustic performance thereof can be maintained.

In the twelfth aspect of the present invention, a surface density of the acoustic material is set at 0.6 to 100 $kg/m^2$(0.1 to 20 $lb/ft^2$), and a flow resistance value thereof is set at 50 to 4000 $N \cdot s/m^3$(10 $lb/ft^2 s$ to 800 $lb/ft^2 s$).

According to the twelfth aspect of the present invention, the acoustic performance can be highly maintained owing to the above configuration.

The thirteenth aspect of the present invention is soundproof wall equipment including: the sound absorbing panel according to the above aspects; and the soundproof panels arranged in plural stages in the vertical direction, the sound absorbing panel being provided and fixed further above an uppermost one of the soundproof panels.

According to the thirteenth aspect of the present invention, generally, most part of sound generated on the sound source side such as a road is insulated by the soundproof panels arranged in plural stages in the vertical direction.

Meanwhile, in the space above the upper end edge of the uppermost soundproof panel, the closer to the upper end edge the air particles that transfer sound are, the more easily the flow speed of the particles is accelerated, and the sound diffraction phenomenon becomes more likely to occur. However, since the sound absorbing panel is provided and fixed further above the uppermost one of the soundproof panels arranged in plural stages in the vertical direction, and the sound transmitting surfaces are formed at the sound-source-side front surface portion and the back surface portion of the outer frame body or the reinforcement frame body, flow of air to transmit through the acoustic material is not blocked, and the sound is absorbed when the air passes through the acoustic material, thus preventing the sound diffraction phenomenon in which the sound on the sound source side spreads to the back surface side of the soundproof wall equipment.

In particular, of the sound to be absorbed, the high-frequency sound is absorbed by the part, of the acoustic material, in which the whole peripheral surface is air-permeable. Thus, high acoustic performance can be achieved over the entire frequency sound region from low frequency to high frequency.

Therefore, the soundproof wall equipment can, as a whole, effectively prevent sound from spreading from the sound source on the road to the peripheral residential area, for example.

DESCRIPTION OF EMBODIMENTS

Hereinafter, embodiments of the present invention will be described on the basis of the drawings.

Figure 1:
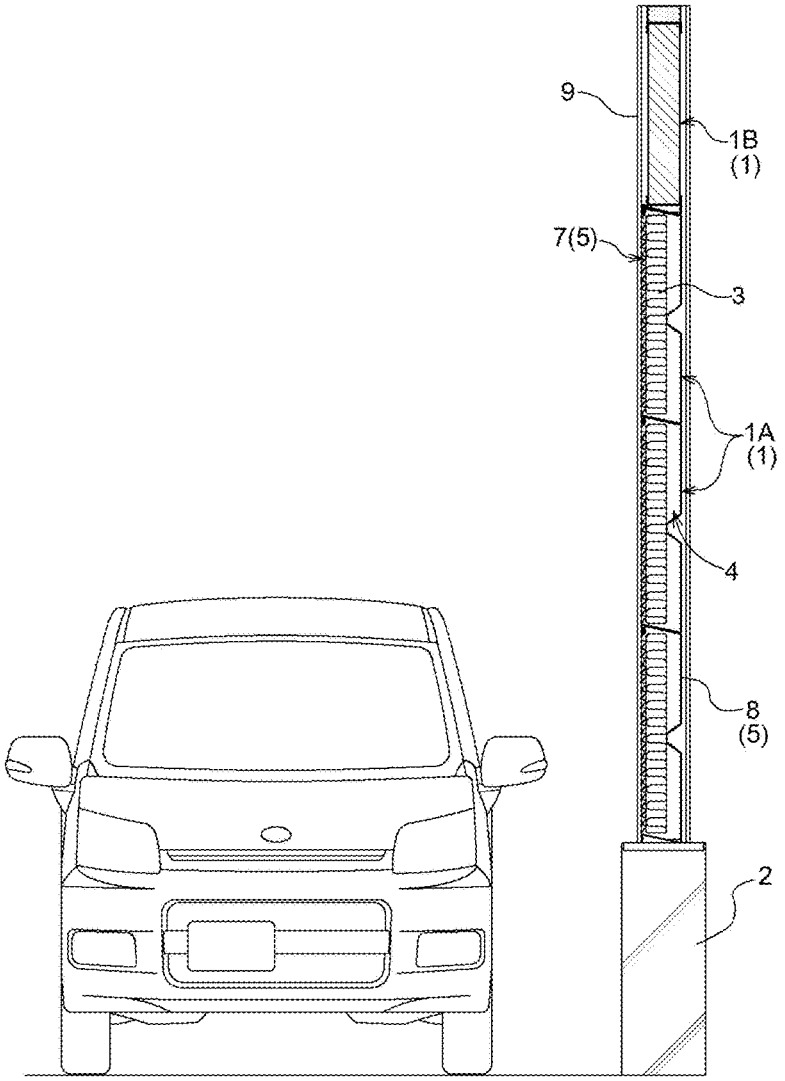
FIG. 1 is a vertical sectional view of soundproof wall equipment.
Figure 2:
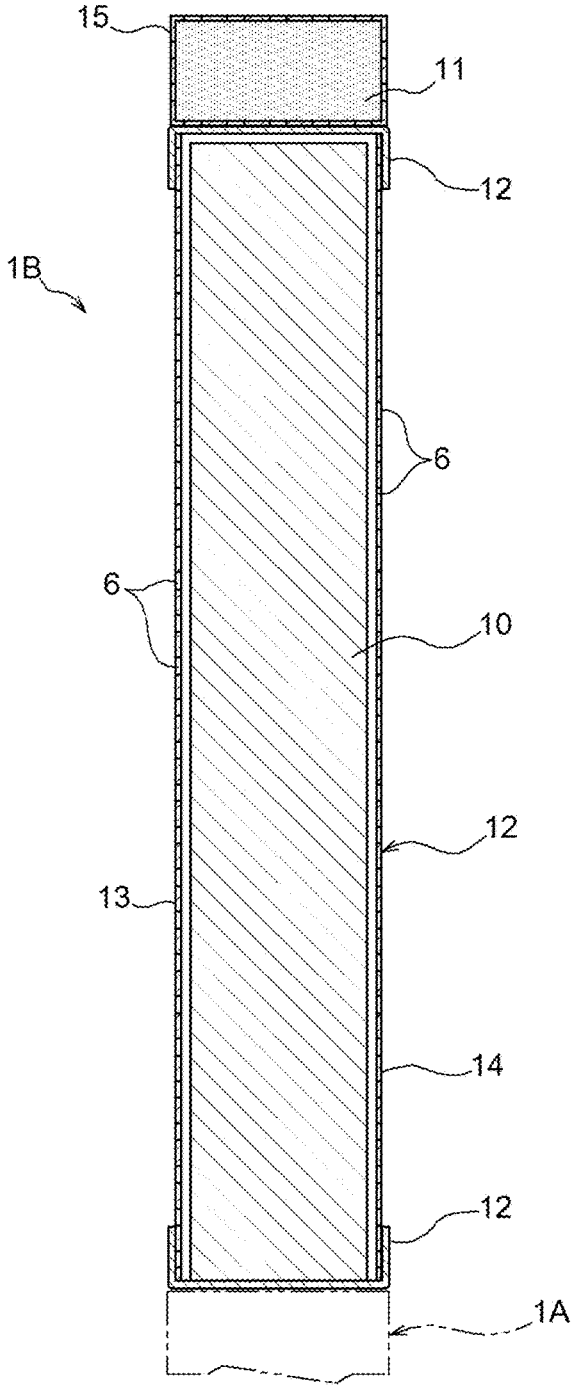
FIG. 2 is a vertical sectional view of a sound absorbing panel.

As shown in FIG. 1 and FIG. 2, soundproof wall equipment on, for example, a road or the like, is configured such that panels 1 are stacked in plural stages in the vertical direction in vertical ditches of panel support H-type steels 9 standing, at regular intervals along the road, on the lateral side of the road, so as to separate the road and the area around the road from each other, and the resultant units are arranged along the road.

First Embodiment

As shown in FIG. 1 and FIG. 2, the panels 1 include: soundproof panels 1A stacked in plural stages in the vertical direction on a foundation outer wall 2 made of concrete; and a sound absorbing panel 1B provided further above the uppermost one of the soundproof panels 1A.

Both right and left ends of each of the soundproof panels 1A and the sound absorbing panels 1B are fitted into the vertical ditch of each of the panel support H-type steels adjacent in the horizontal direction, whereby the soundproof panels 1A are supported by the panel support H-type steel.

As shown in FIG. 1 and FIG. 2, the soundproof panel 1A has an outer frame body 5 formed of a metal plate, having therein an acoustic space 4 in which an acoustic material 3 formed of glass wool is provided, and allowing formation of a partition wall separating the road as a sound source and the area around the road from each other.

In a sound-source-side front surface portion 7 of the outer frame body 5, a sound transmitting surface is formed which has a louver structure in which multiple sound through holes allowing external sound to be taken into the acoustic space 4 are formed. At a back surface portion 8 opposite to the sound source side, of the outer frame body 5, a sound insulating plate having no holes and formed of an iron plate is provided. Thus, the soundproof panel 1A is configured so as not to allow sound generated from the road side to be released to the back surface side of the soundproof wall.

As shown in FIG. 2, the sound absorbing panel 1B is configured as follows.

First Embodiment

That is, the sound absorbing panel 1B has an outer frame body 12 having therein an acoustic space in which a first acoustic material 10 is provided, and allowing formation of a partition wall separating the sound source and the area around the sound source from each other. Sound transmitting surfaces having multiple sound through holes 6 allowing transfer of sound between the acoustic space and the outside thereof is formed at a sound-source-side front surface portion 13 and a back surface portion 14 of the outer frame body 12. Further above the upper end of the outer frame body 12, a second acoustic material 11 is provided with the whole peripheral surface thereof being air-permeable.

The outer frame body 12 is composed of two or more sheet metal members, and is formed by integrally assembling the plurality of sheet metal members into a box shape by a rivet, a bolt and a nut, bonding, welding, or the like.

Two surfaces, i.e., the front surface and the back surface, of the outer frame body 12 are formed of punching metal made of aluminum and having multiple sound through holes 6 allowing external sound to be taken into the acoustic space in the outer frame body 12. In addition, the first acoustic material 10 formed of polyester wool is provided in the acoustic space.

Also for the second acoustic material 11 attached above the outer frame body 12, a porous material formed of polyester wool is used, as in the first acoustic material 10. The surface densities of the first and second acoustic materials 10 and 11 are set at 0.6 to 100 $kg/m^2$ (0.1 to 20 $lb/ft^2$)and the flow resistance values thereof are set at 50 to 4000 $N{\cdot}s/m^3$(10 $lb/ft^2s$ to 800 $lb/ft^2s$).

The outer frame body 12 is not provided outside the second acoustic material 11, but a porous surface body 15 covers and protects the second acoustic material 11.

The porous surface body 15 protecting the second acoustic material 11 is formed of punching metal, a wire net, cloth, a metallic sintered material, or the like. As an example, the opening ratio of the punching metal may be greater than about 32% if the panel rigidity is ensured, or may need to be about 32% or not greater than 32% if it is difficult to ensure the panel rigidity.

Second Embodiment

Figure 6:
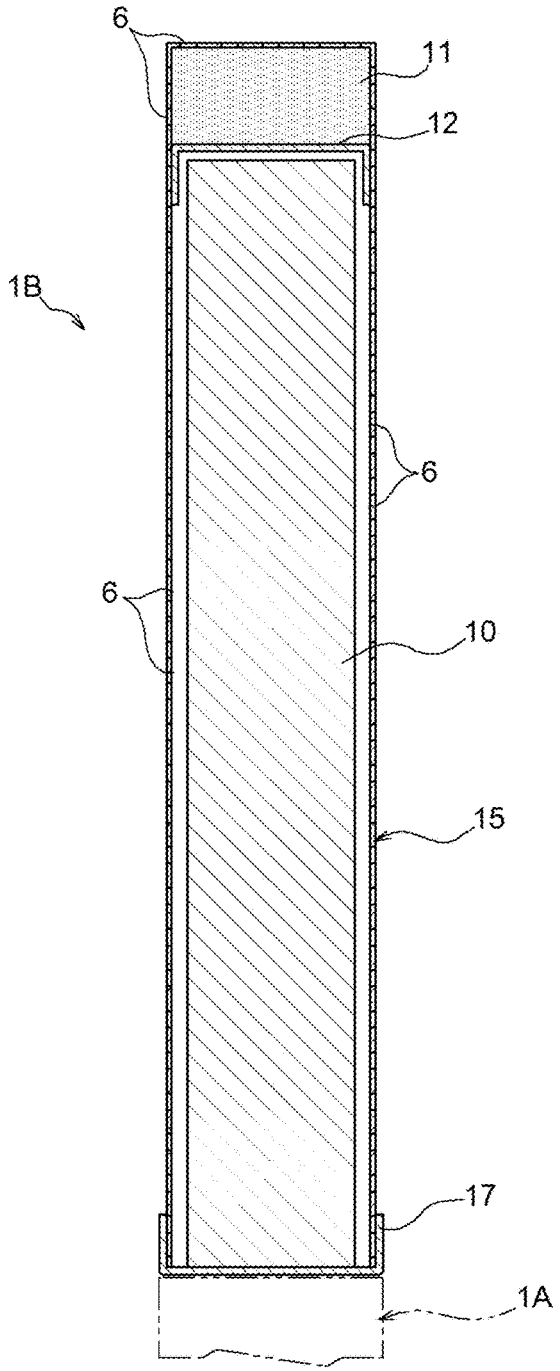
FIG. 6 is a vertical sectional view according to the second embodiment.

In the second embodiment, the sound absorbing panel 1B is configured as shown in FIG. 6.

That is, in the sound absorbing panel 1B, one panel-like acoustic material 16 is provided, and a reinforcement frame body 17 reinforcing only a lower part below an intermediate portion in the vertical direction of the acoustic material 16 while leaving an upper part above the intermediate portion in an air-permeable state over the whole peripheral surface. Multiple sound through holes 6 allowing transfer of sound between inside and outside of the acoustic material 16 are formed in the sound-source-side front surface portion 13 and the back surface portion 14 of the porous surface body 15.

It is noted that, as shown in FIG. 6, the reinforcement frame body 17 may be provided inside the porous surface body 15 and a part of the reinforcement frame body 17 may be recessed into the acoustic material 16, or alternatively, the reinforcement frame body 17 may be provided outside the porous surface body 15.

EXAMPLES

Next, the effect of edge effect suppression by the sound absorbing panel 1B in the soundproof wall equipment was measured on the basis of difference in the structure of each panel.

Example 1

Figure 3:
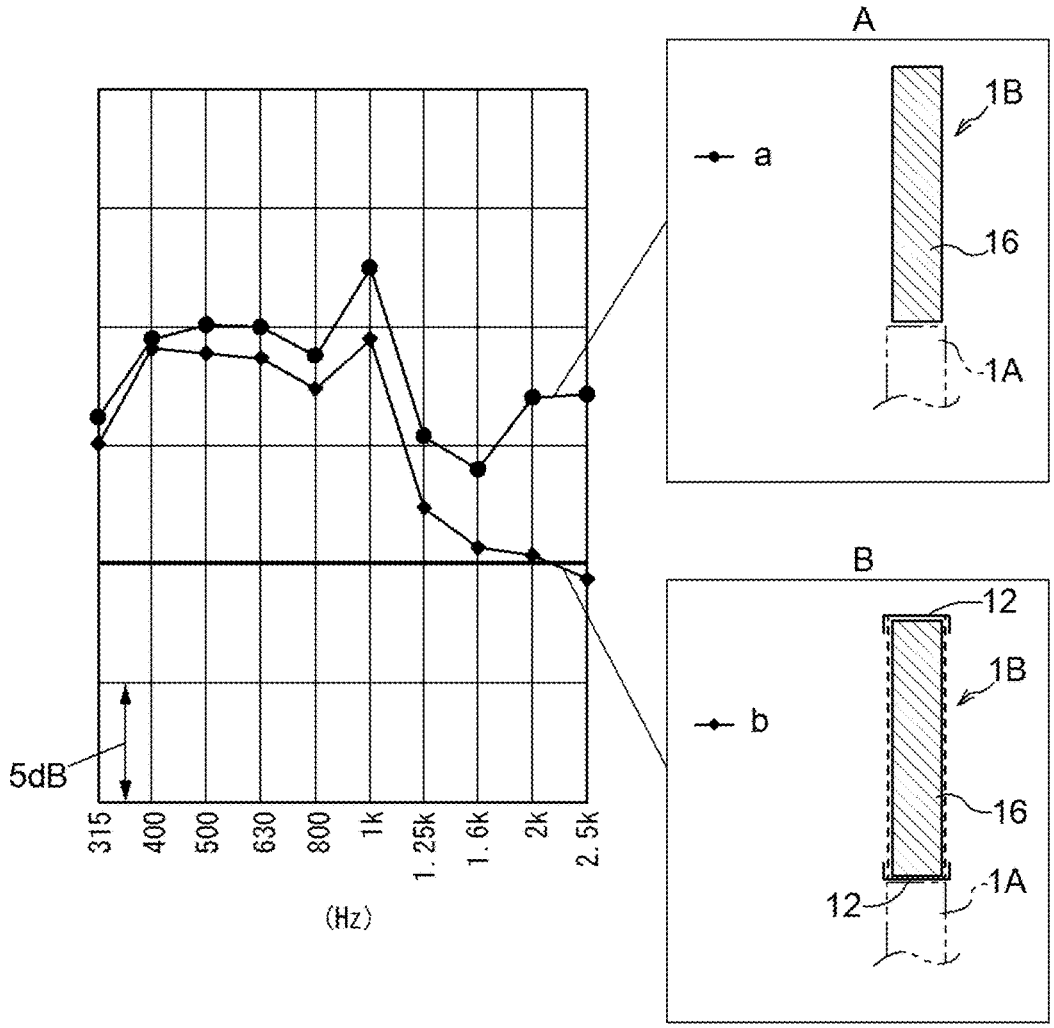
FIG. 3 shows schematic structure diagrams of sound absorbing panels A and B, and a graph obtained by measuring their effects of edge effect suppression.

As shown in FIG. 3, the acoustic material 16 formed of polyester wool is provided on the soundproof panel 1A. In an experimental subject A, the sound absorbing panel 1B was provided with an upper portion thereof opened. In an experimental subject B, the acoustic material 16 was stored inside the outer frame body 12 (an upper portion of the panel was closed) made of metal, and then provided above the soundproof panel 1A. The effects of edge effect suppression in these experimental subjects are shown in a graph (FIG. 3).

It is noted that measurement was performed at a side (sound receiving side) opposite to the sound source side with respect to the soundproof panel. The horizontal axis in the graph indicates the frequency (Hz) of sound from 315 Hz to 2.5 kHz. The vertical axis in the graph indicates the degree of edge effect suppression (transmitting sound suppression) at each frequency, with one scale corresponding to 5 dB. In the graph, a polygonal line a indicates change in the measurement value for the experimental subject A, and a polygonal line b indicates change in the measurement value for the experimental subject B.

Thus, the experimental subject A having no outer frame body 12 exhibits a greater suppression effect, and in particular, exhibits a great suppression effect in a high-frequency sound region.

Example 2

Figure 4:
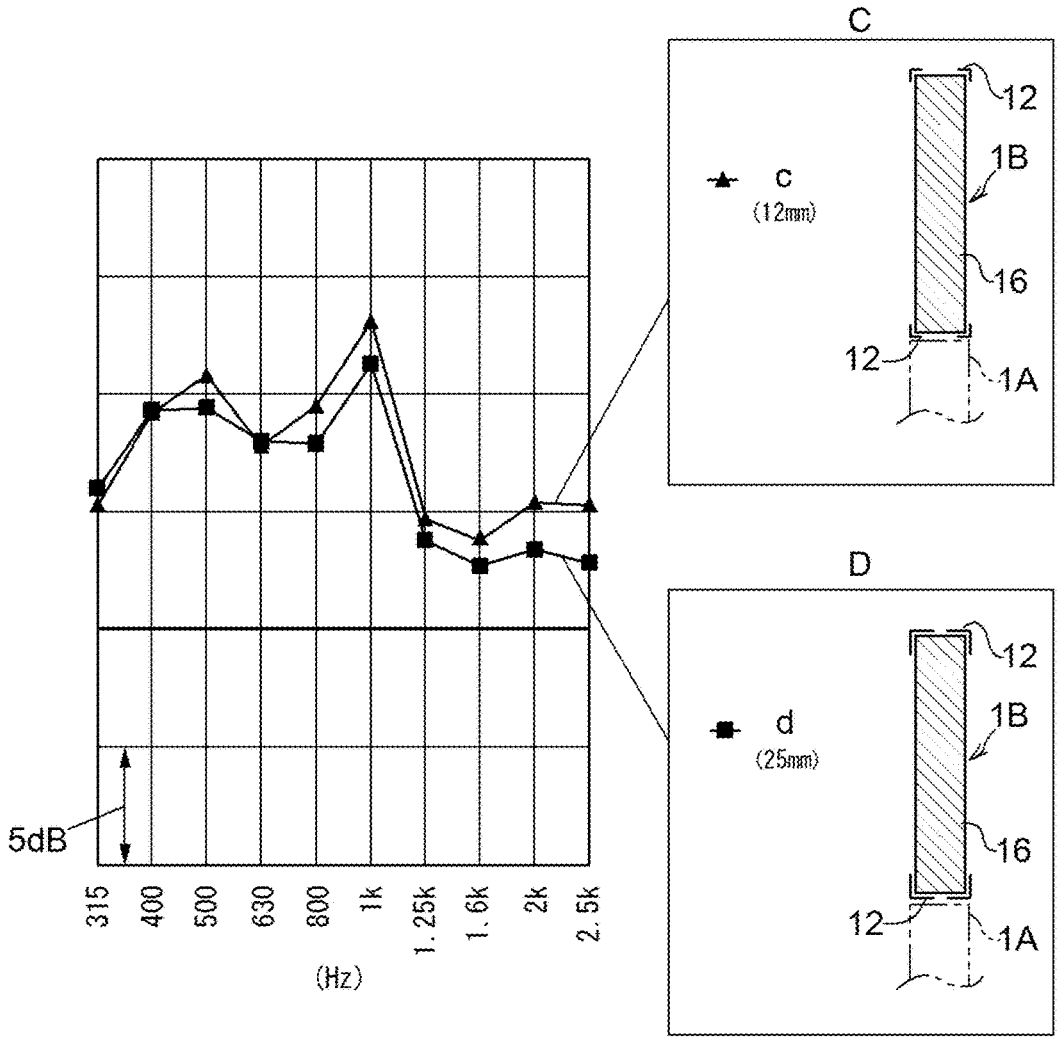
FIG. 4 shows schematic structure diagrams of sound absorbing panels C and D, and a graph obtained by measuring their effects of edge effect suppression.

As shown in FIG. 4, the sound absorbing panel 1B having the acoustic material 16 stored in the internal space of the outer frame body 12 made of metal is provided above the soundproof panel 1A. The outer frame body 12 of the sound absorbing panel 1B is configured such that each peripheral portion is surrounded by an angle member so as to be reinforced, with an opening formed at the upper portion.

A subject (C) using an angle member having a width of 12 mm and a subject (D) using an angle member having a width of 25 mm were prepared, and the effect of edge effect suppression was measured for each subject. A result thereof is shown in a graph (FIG. 4).

It is noted that measurement was performed at a side (sound receiving side) opposite to the sound source side with respect to the soundproof panel. The horizontal axis in the graph indicates the frequency (Hz) of sound from 315 Hz to 2.5 kHz. The vertical axis in the graph indicates the degree of edge effect suppression (transmitting sound suppression) at each frequency, with one scale corresponding to 5 dB. In the graph, a polygonal line c indicates change in the measurement value for the experimental subject C, and a polygonal line d indicates change in the measurement value for the experimental subject D.

Thus, the sound absorbing panel 1B using the angle member having a smaller width of 12 mm exhibits a greater effect.

Example 3

Figure 5:
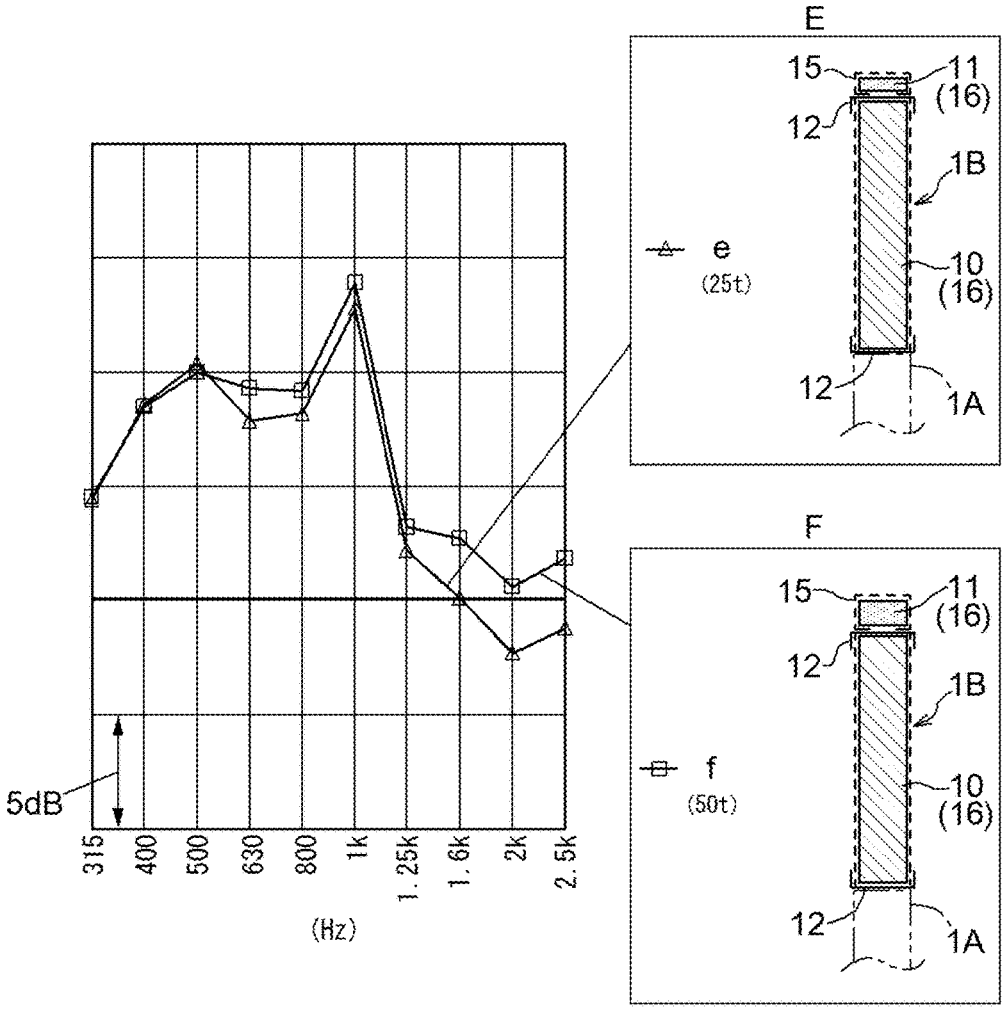
FIG. 5 shows schematic structure diagrams of sound absorbing panels E and F, and a graph obtained by measuring their effects of edge effect suppression.

As shown in FIG. 5, the sound absorbing panel 1B provided above the soundproof panel 1A is provided with the outer frame body 12 having therein an acoustic space in which the first acoustic material 10 is provided, and allowing formation of a partition wall separating the sound source and the area around the sound source from each other.

Sound transmitting surfaces having multiple sound through holes allowing transfer of sound between the acoustic space and the outside thereof are formed at the sound-source-side front surface portion 13 and the back surface portion 14 of the outer frame body 12.

Further above the upper end of the outer frame body 12, the second acoustic material 11 is provided with the whole peripheral surface thereof being air-permeable.

A subject (E) using the second acoustic material 11 having a vertical thickness of 25 mm, and a subject (F) using the second acoustic material 11 having a vertical thickness of 50 mm were prepared, and the suppression effect was measured for each subject. A result thereof is shown in a graph (FIG. 5).

It is noted that measurement was performed at a side (sound receiving side) opposite to the sound source side with respect to the soundproof panel. The horizontal axis in the graph indicates the frequency (Hz) of sound from 315 Hz to 2.5 kHz. The vertical axis in the graph indicates the degree of edge effect suppression (transmitting sound suppression) at each frequency, with one scale corresponding to 5 dB. In the graph, a polygonal line e indicates change in the measurement value for the experimental subject E, and a polygonal line f indicates change in the measurement value for the experimental subject F.

Thus, the experimental subject with a greater thickness of 50 mm exhibits performance closer to that of the experimental subject A, and in particular, exhibits a great suppression effect in a high-frequency sound region.

Other Embodiments

Hereinafter, other embodiments will be described.

<1> The acoustic materials 10, 11, 16 may be formed of, instead of polyester wool, a porous material made from an inorganic fiber such as glass wool or rock wool, or a porous material made from a metal fiber such as a stainless steel fiber, or other than these, an aluminum sintered plate, a ceramic sintered plate, molten slag, or the like.

<2> The acoustic materials 10, 11, 16 may have a complex structure obtained by combining two or more types of the above acoustic materials, e.g., combining polyester wool and an aluminum sintered plate.

<3> The punching metal may be formed of a metal plate such as stainless steel or a galvanized steel sheet, instead of aluminum. Alternatively, the punching metal may be a resin plate made of polycarbonate, acrylic, or the like.

<4> The soundproof wall equipment may be used for the railroad, general soundproof wall equipment, or a partition in a room, instead of the road.

<5> The front surface portion of the outer frame body 12 may be formed of a metal mesh, a metal plate with a louver structure or of a louver type, or a metallic sintered plate, instead of punching metal.

Figure 7:
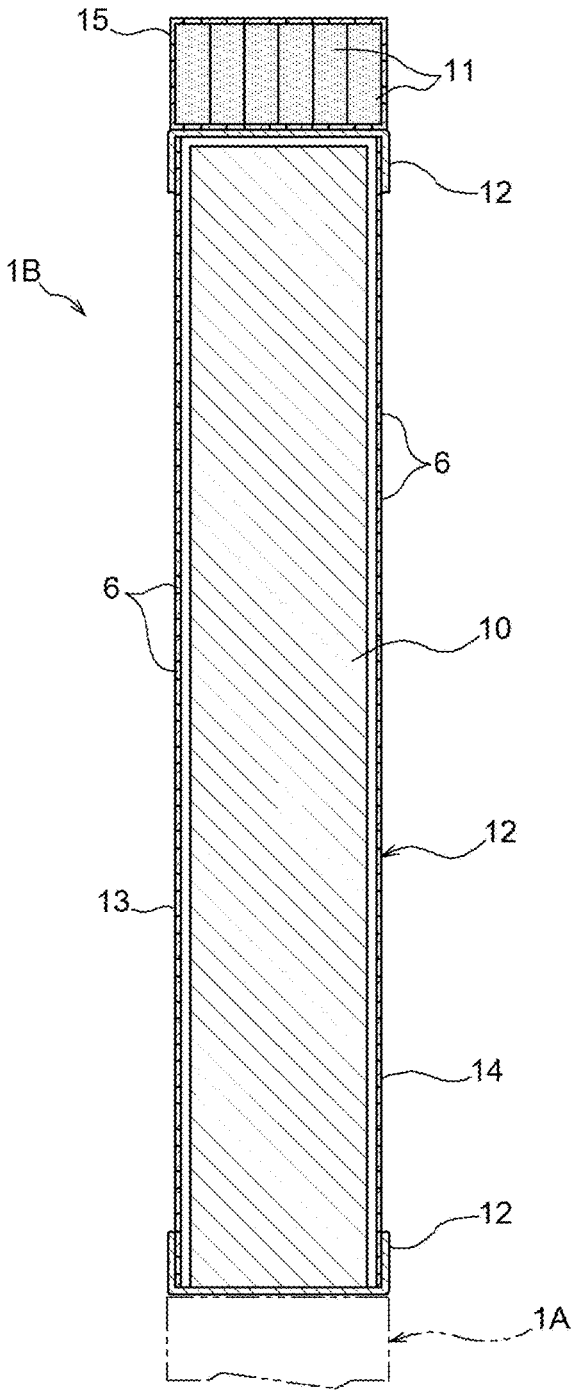
FIG. 7 is a vertical sectional view according to another embodiment.

<6> As shown in FIG. 7, inside a box shape obtained by surrounding the whole periphery by the porous surface body 15 having multiple sound through holes 6, the outer frame body 12 for reinforcement may be provided, the first acoustic material 10 may be provided inside the box-shaped porous surface body 15 and inside the outer frame body 12, and the second acoustic material 11 may be provided above the outer frame body 12.

<7> The second acoustic material 11 may be provided as an acoustic material alone without being protected by the porous surface body 15.

Figure 8:
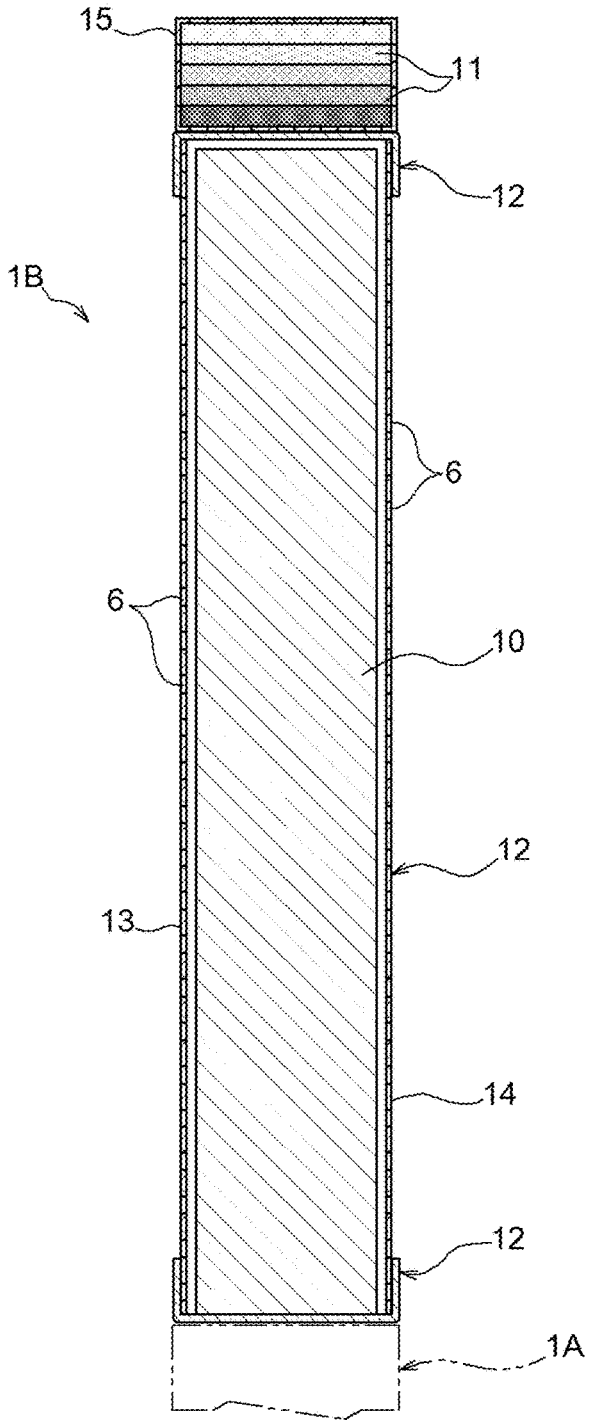
FIG. 8 is a vertical sectional view according to another embodiment.
Figure 9:
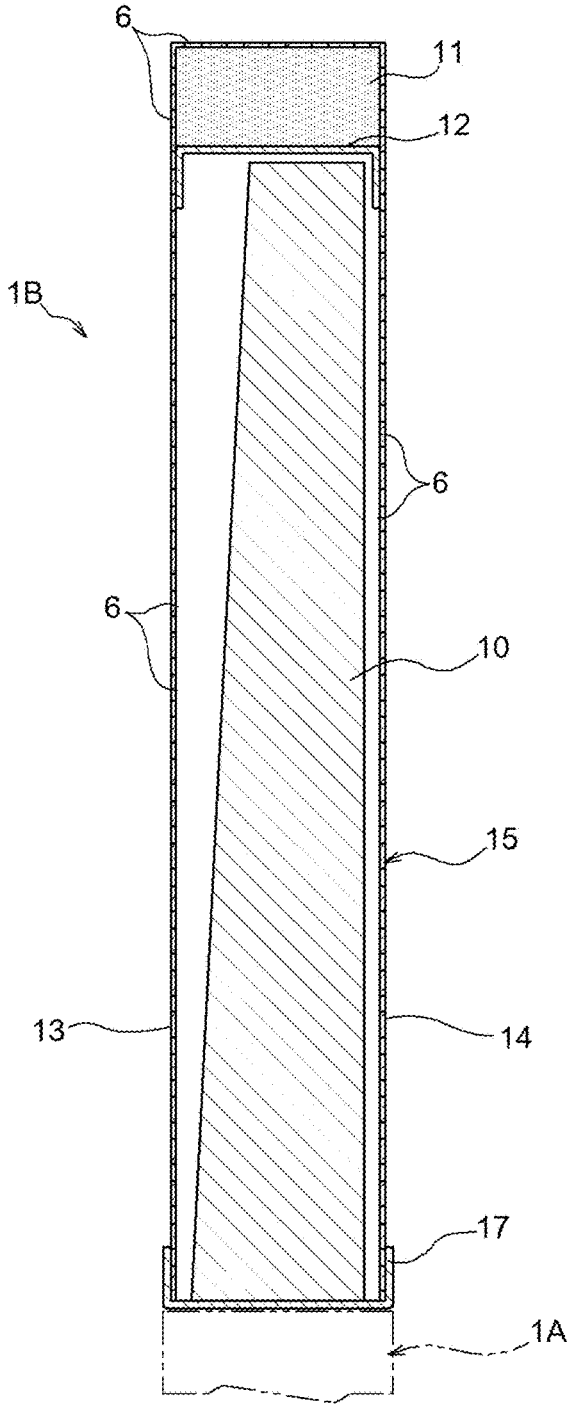
FIG. 9 is a vertical sectional view according to another embodiment.

<8> In the case of using a thin plate-like material as the second acoustic material 11, the thin plate-like materials may be stacked in the vertical direction with their front and back surfaces in parallel with the upper surface of the outer frame body 12, to set the height thereof in the vertical direction. Alternatively, as shown in FIG. 8, the thin plate-like materials may be arranged in the thickness direction of the panel with their front and back surfaces standing along the vertical direction. In addition, as shown in FIG. 9, in the case where, as the second acoustic material 11, in particular, a plurality of thin plate-like materials are stacked in the vertical direction (the thin plate-like materials are stacked in the vertical direction with their front and back surfaces in parallel with the upper surface of the outer frame body 12, to set the height thereof in the vertical direction), acoustic materials having different densities or acoustic materials made of different types of materials may be stacked, thereby adjusting the acoustic characteristics or the air flow resistance value as a whole. In this case, it is desirable that the uppermost acoustic material has a smaller density than the lowermost acoustic material.

Figure 10:
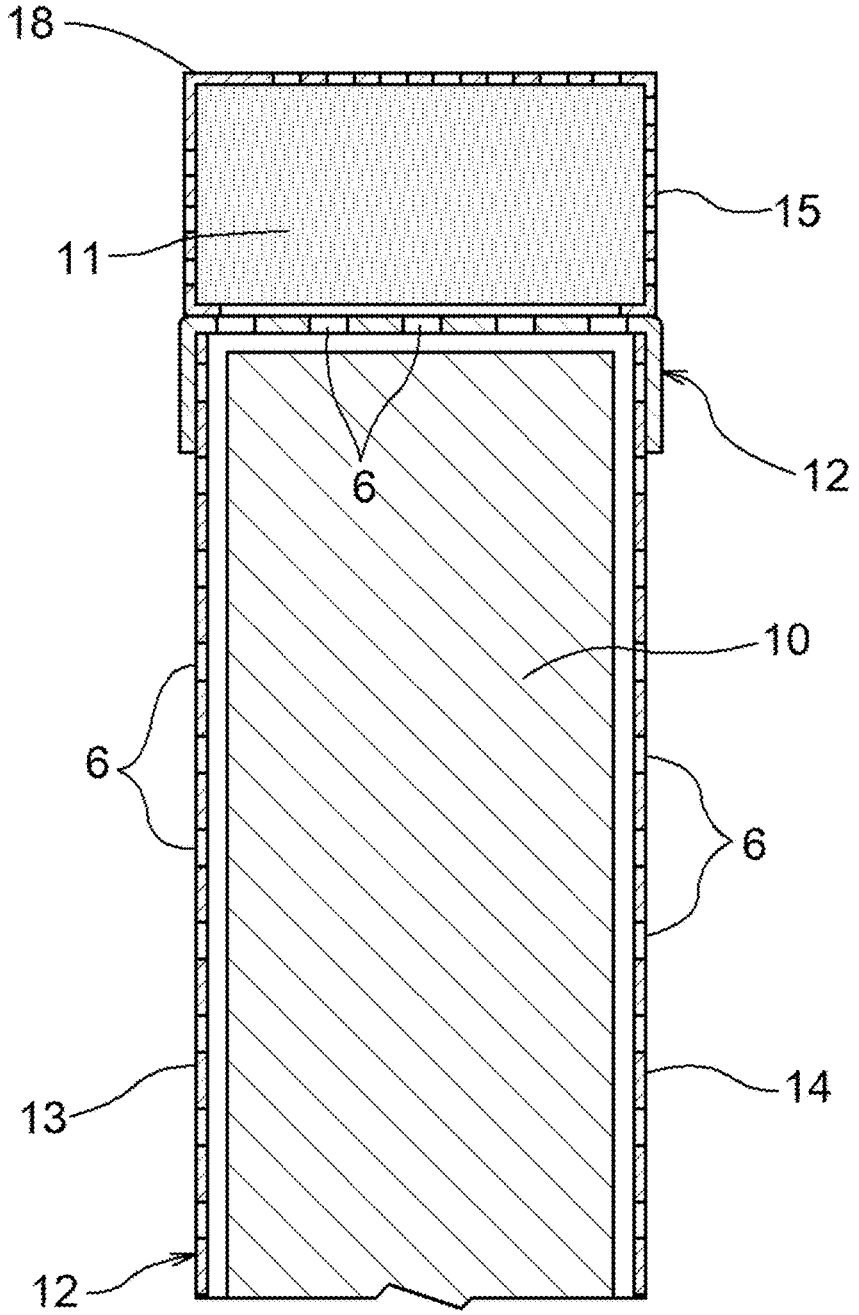
FIG. 10 is a vertical sectional view according to another embodiment.

<9> As shown in FIG. 10, the first acoustic material 10 may be formed such that the thickness thereof decreases toward the upper side, whereby the ventilation resistance is decreased toward the upper side.

Figure 11:
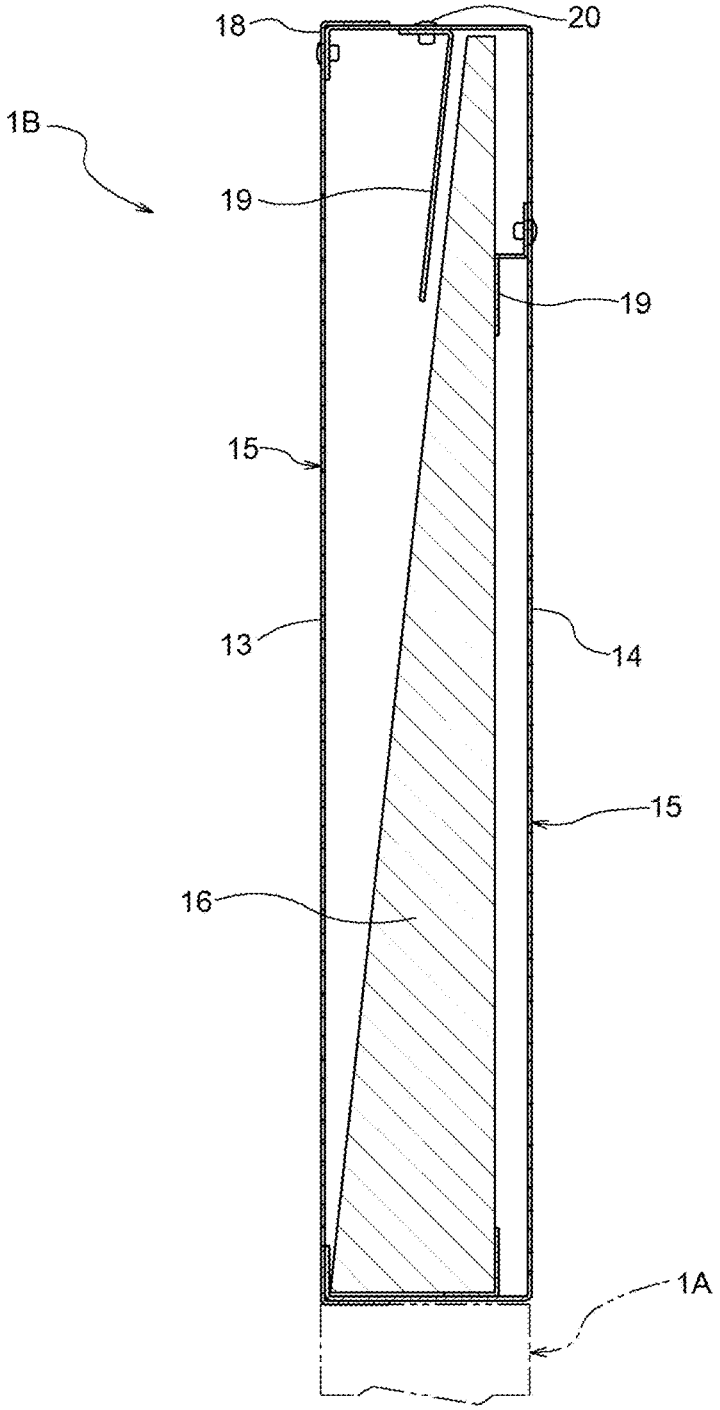
FIG. 11 is a vertical sectional view according to another embodiment.
Figure 12:
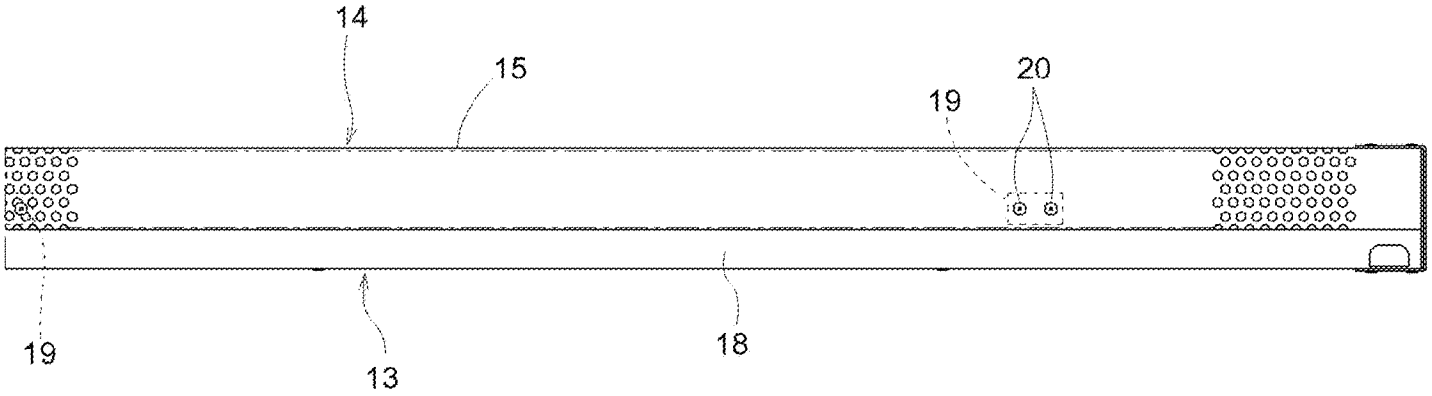
FIG. 12 is a vertical sectional view of a sound absorbing panel according to another embodiment.
Figure 13:
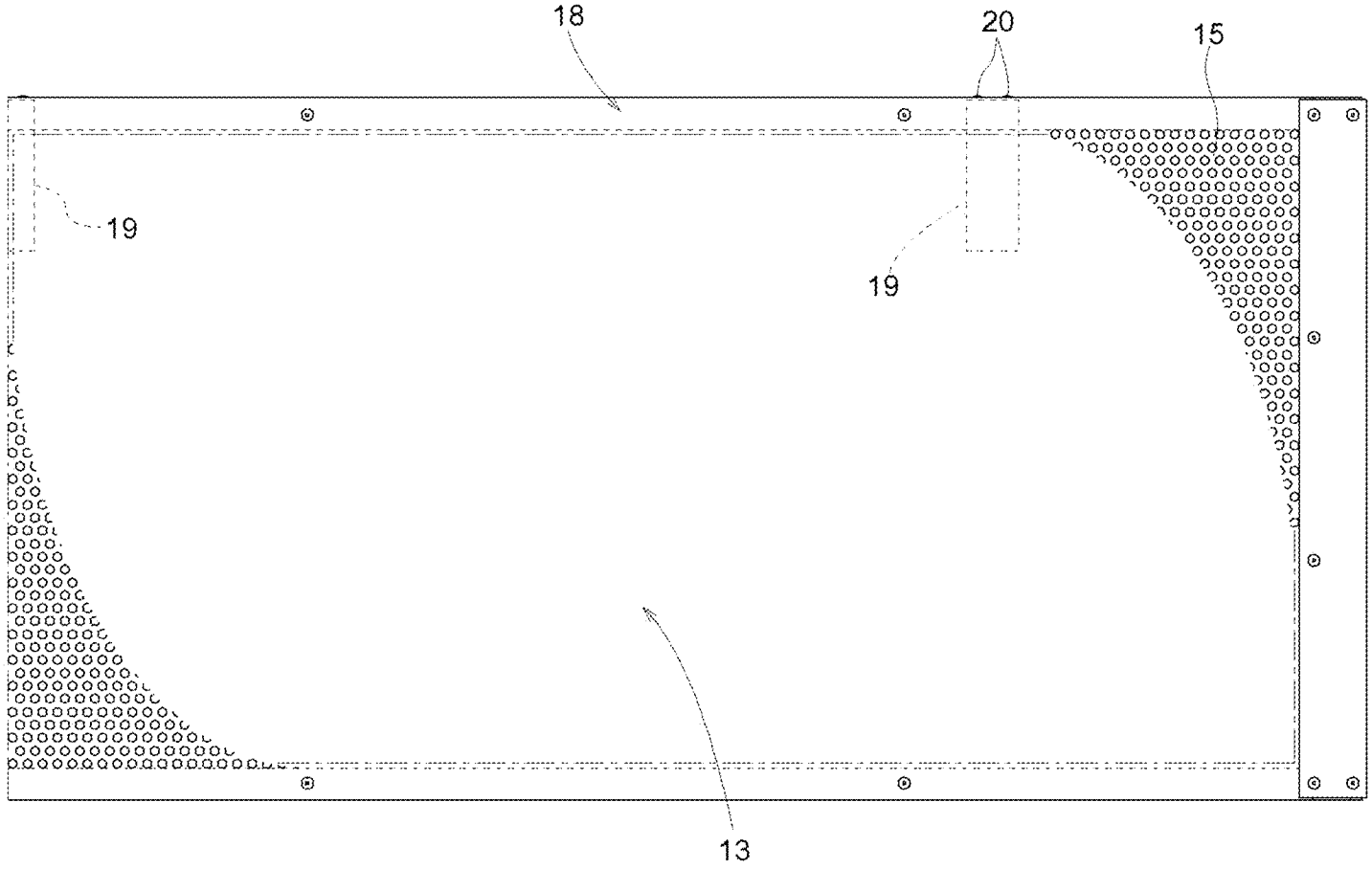
FIG. 13 is a plan view of the sound absorbing panel in FIG. 12.
Figure 14:
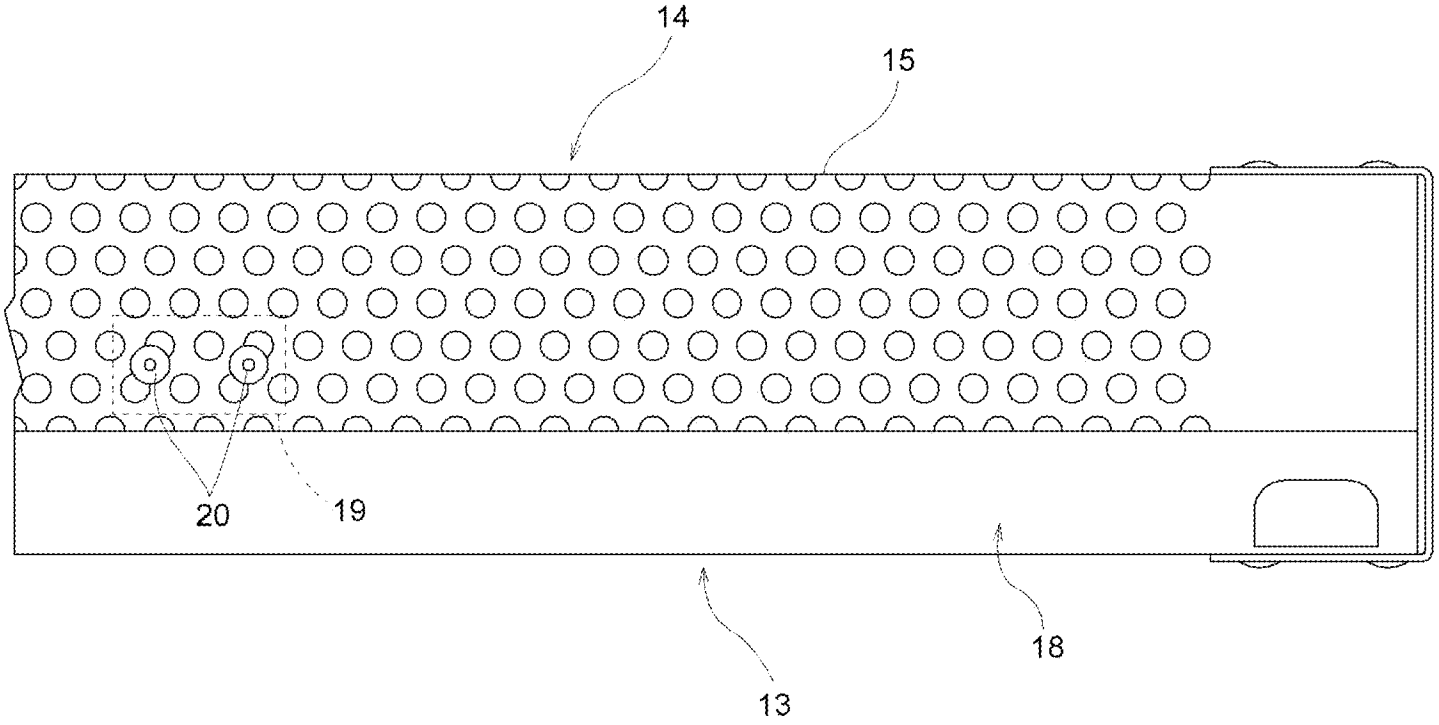
FIG. 14 is a front view of the sound absorbing panel in FIG. 12.
Figure 15:
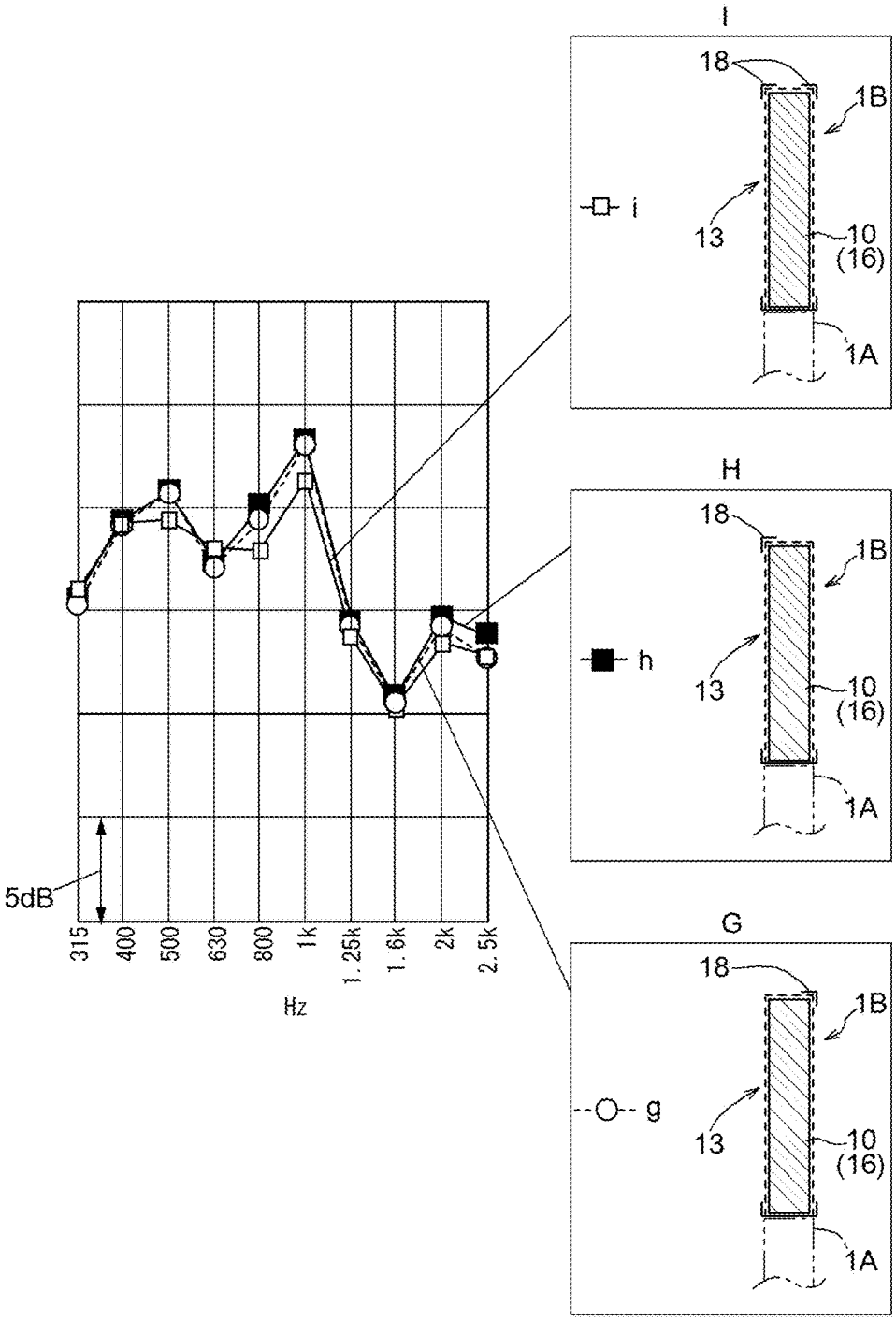
FIG. 15 is a specific part enlarged view of the sound absorbing panel in FIG. 13.

<10> In order to further reinforce the sound absorbing panel 1B in the first embodiment, as shown in FIG. 11, a corner portion of an upper end edge on the sound source side of the porous surface body 15 formed of punching metal for protecting the second acoustic material 11 may be formed to be a metal plate portion having no holes, thereby forming a reinforcement portion 18. Thus, while the holding function for the second acoustic material 11 is improved, the same acoustic effect as in the first embodiment can be expected. As the reinforcement portion 18, an independent reinforcement member such as an angle member may be attached at the corner portion of the upper end edge on the sound source side of the porous surface body 15 formed of punching metal.

That is, the second acoustic material 11 only needs to be provided such that at least the peripheral surface thereof except for the corner portion of the upper end edge on the sound source side is air-permeable.

<11> As in the above other embodiment, in order to further reinforce the sound absorbing panel 1B of the second embodiment, an auxiliary reinforcement portion may be provided at a corner portion of an upper end edge on the sound source side in an upper part above an intermediate portion in the vertical direction of the acoustic material 16. That is, the corner portion of the upper end edge on the sound source side of the porous surface body 15 formed of punching metal is formed to be a metal plate portion having no holes, thereby forming an auxiliary reinforcement portion. As the auxiliary reinforcement portion, an individual reinforcement member such as an angle member may be attached at the corner portion of the upper end edge on the sound source side of the porous surface body 15 formed of punching metal.

<12> Instead of the sound absorbing panel 1B shown in FIG. 6 in which the reinforcement frame body is provided for reinforcing the lower part below the intermediate portion in the vertical direction of the acoustic material 16, as shown in FIG. 12 to FIG. 15, the sound absorbing panel 1B may be configured such that the acoustic material 16 formed such that the thickness thereof decreases toward the upper side is provided in the acoustic space, and a bottom portion and a corner portion of an upper end edge on the sound source side of the porous surface body 15 protecting the whole periphery of the acoustic material 16 and formed of punching metal are formed to be metal plate portions having no holes, thereby forming the reinforcement portions 18. It is noted that numeral 19 in the drawings denotes a belt plate holding the acoustic material 16, and the belt plates are attached, with rivets 20, to the porous surface body 15 at a plurality of locations in the horizontal width direction of the sound absorbing panel 1B. It is noted that the acoustic material 16 may have a thickness uniformed in the vertical direction. That is, the reinforcement portions 18 formed at the bottom portion and the corner portion of the upper end edge on the sound source side do not hinder, in particular, high-frequency sound of sound diffracted above the soundproof panel 1A from being absorbed by the acoustic material 16.

Figure 16:
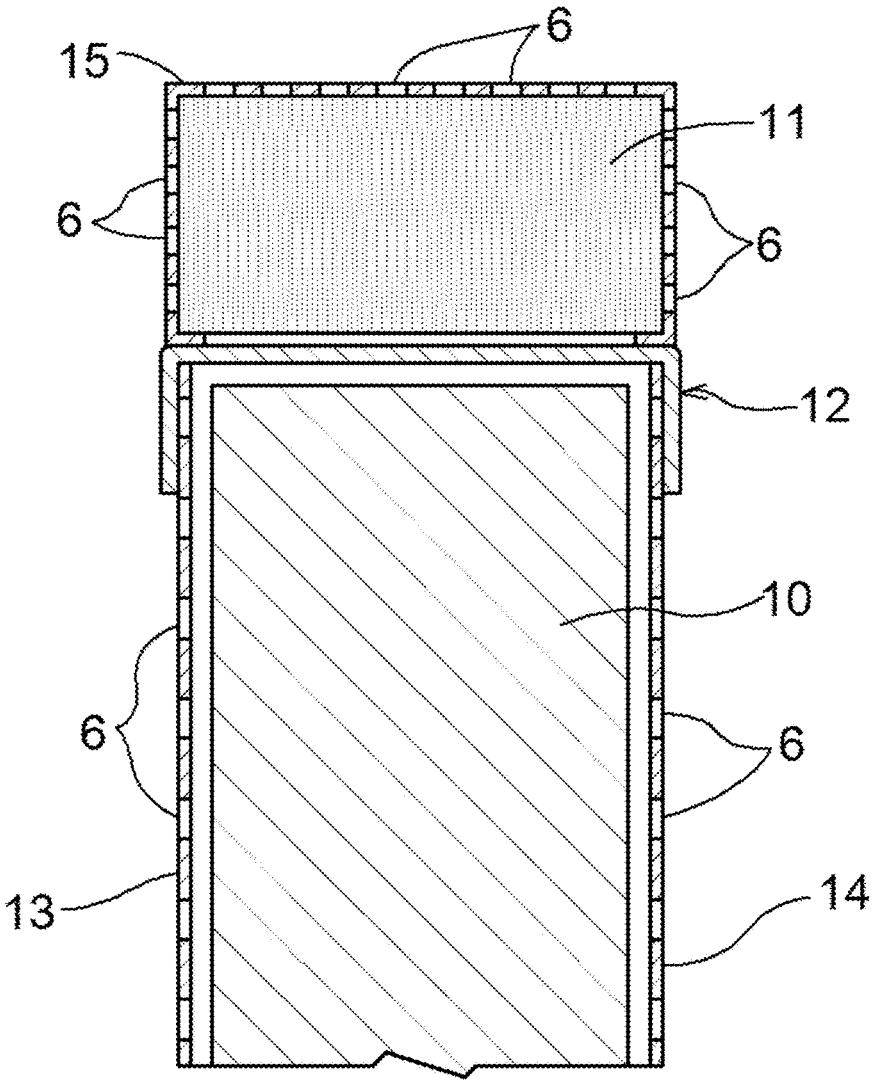
FIG. 16 is a graph obtained by measuring the effect of edge effect suppression according to another embodiment.

It is noted that FIG. 16 shows the effect of edge effect suppression in the case of providing L angles as reinforcement portions for holding the acoustic material and reinforcing the entire panel. A polygonal line graph g indicates a result of providing the L angle only on the sound receiving side of upper end corner portions of the panel. A polygonal line graph h indicates a result of providing the L angle only on the sound source side. A polygonal line graph i indicates a result of providing the L angles on both the sound receiving side and the sound source side. As is found from the changes in the polygonal line graphs, the panel provided with the L angle only on the sound source side exhibits a high suppression effect.

Measurement was performed at a side (sound receiving side) opposite to the sound source side with respect to the soundproof panel. The horizontal axis in the graph indicates the frequency (Hz) of sound from 315 Hz to 2.5 kHz. The vertical axis in the graph indicates the degree of edge effect suppression (transmitting sound suppression) at each frequency, with one scale corresponding to 5 dB.

Figure 17:
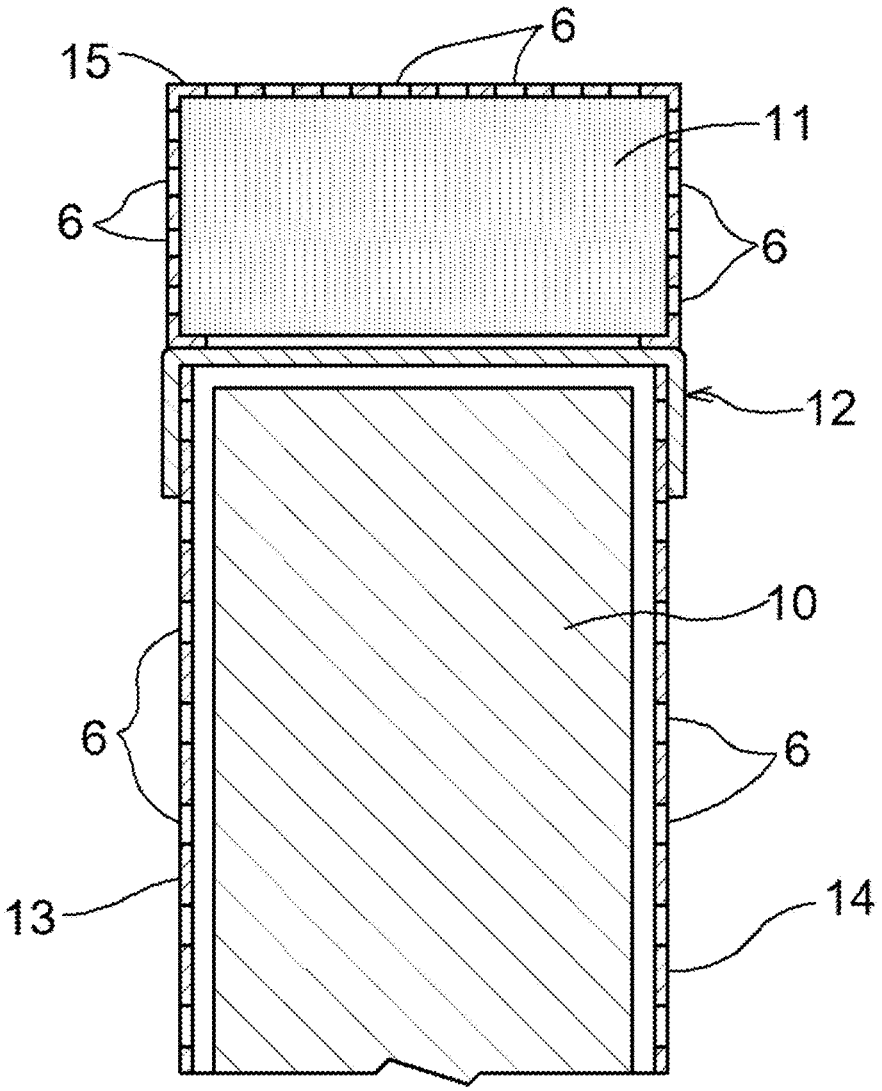
FIG. 17 is a specific part vertical sectional view according to another embodiment.
Figure 18:
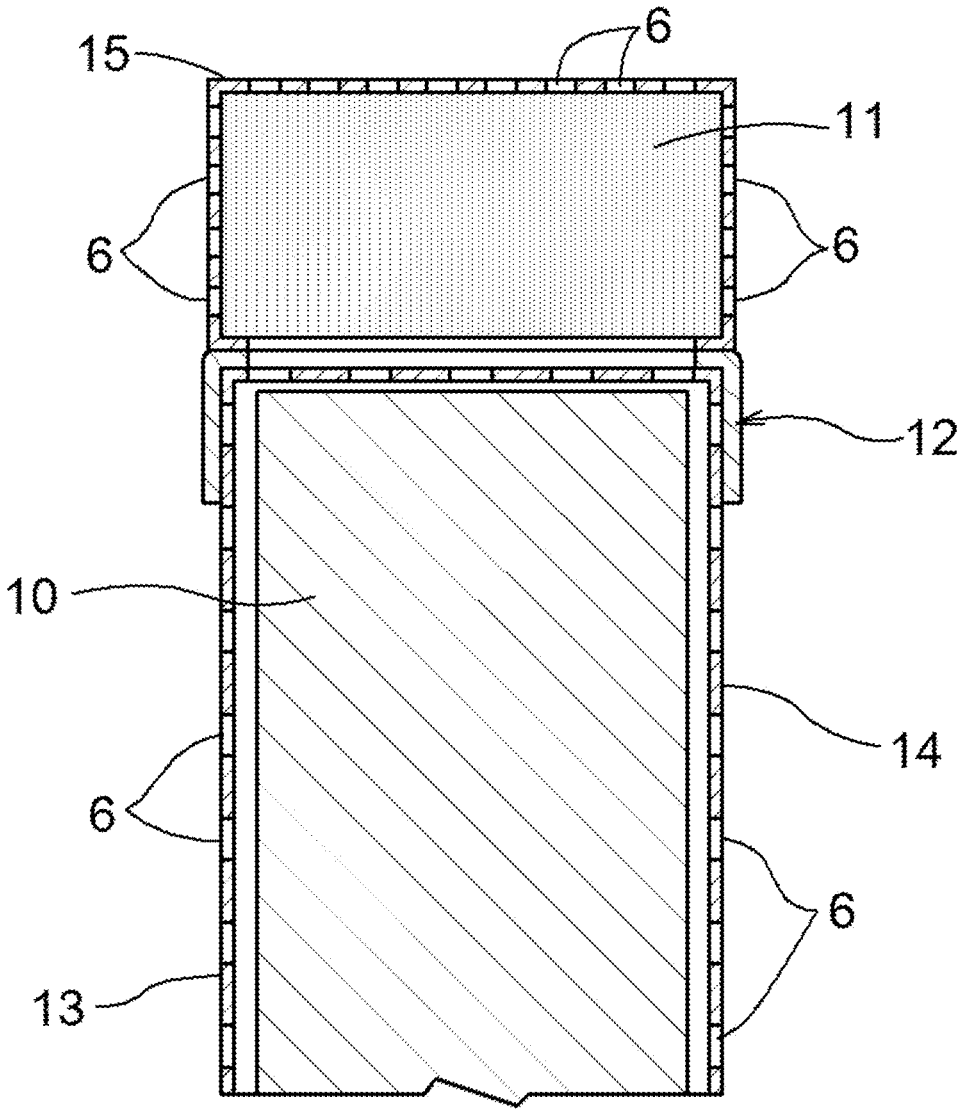
FIG. 18 is a specific part vertical sectional view according to another embodiment.

<13> Instead of the structure shown in FIG. 2, as shown in FIG. 17, the porous surface body 15 may not be formed between the second acoustic material 11 and the outer frame body 12 thereunder. In addition, instead of the structure shown in FIG. 11, as shown in FIG. 18, of the outer frame body 12, the center portion under the second acoustic material 11 may be removed and opened.

It is noted that, although in the above description, the reference characters are indicated for convenience of reference to the drawings, the present invention should not be limited to the configurations shown in the accompanying drawings, by such indication. In addition, as a matter of course, the present invention may be implemented in various modes without deviating from the gist of the present invention.

DESCRIPTION OF THE REFERENCE CHARACTERS

1A soundproof panel
1B sound absorbing panel
10 first acoustic material
11 second acoustic material
12 outer frame body
13 sound-source-side front surface portion
14 back surface portion
15 porous surface body

The invention claimed is:

1. A sound absorbing panel configured to be provided on a soundproof panel comprising:

an outer frame body having therein an acoustic space in which a first acoustic material is provided, the outer frame body includes a front surface portion at a front side and a back surface portion at a back side each of the front surface portion and the back surface portion includes through holes, the outer frame body includes a reinforcement portion that covers a front upper corner portion of a front-surface-side of the first acoustic material, a back upper corner portion of a back-surface-side of the first acoustic material and an upper surface of the first acoustic material between the front-upper corner portion and the back upper corner portion; and a second acoustic material provided on the reinforcement portion, wherein a peripheral surface of the second acoustic material is covered by an air-permeable member.

2. A sound absorbing panel configured to be provided on a soundproof panel comprising:

an outer frame body having therein an acoustic space in which a first acoustic material is provided, the outer frame body a front surface portion at a front side and a back surface portion, the front and back surface portions include through holes; and a second acoustic material provided on an upper end of the outer frame body, wherein a peripheral surface of the second acoustic material except for a corner portion of an upper end edge on the front side and a lower surface portion that faces the upper end is covered by an air-permeable member, a reinforcement portion is provided only at the corner portion, and the lower surface portion is covered by a member with no air-permeability.

3. A sound absorbing panel configured to be provided on a soundproof panel comprising:

an outer frame body having therein an acoustic space in which a first acoustic material is provided, the outer frame body includes a front surface portion at a front side and a back surface portion at a back side, the front and back surface portions include through holes, the outer frame body includes reinforcement portions at corner portions of upper end edges of the front surface portion at the front side and the back surface portion at the back side; and a second acoustic material provided on an upper end of the outer frame body, wherein a peripheral surface of the second acoustic material except for a lower surface portion that faces the upper end is covered by an air-permeable member, and the lower surface portion is covered by a member with no air-permeability.

4. A sound absorbing panel configured to be provided on a soundproof panel comprising:

an acoustic material;

a surface body covering a front side, a back side, and an upper portion of the acoustic material except for a corner portion of an upper end edge of the front side, surfaces of the surface body covering the front side, the back side and upper portion of the acoustic material include through holes;

a reinforcement portion provided at the corner portion only;

an intermediate reinforcement frame body provided at an intermediate portion in a vertical direction on each of the front side and the back side; and a lower reinforcement frame body provided at a lower portion of the surface body, wherein the intermediate reinforcement frame body and the lower reinforcement frame body form a reinforcement frame reinforcing a lower part below the intermediate portion.

5. The sound absorbing panel according to claim 4, wherein the acoustic material is formed of a porous material made of polyester fiber wool.

6. The sound absorbing panel according to claim 4, wherein a surface density of the acoustic material is set at 0.6 to 100 $kg/m^2$(0.1 to 20 $lb/ft^2$), and a flow resistance value thereof is set at 50 to 4000 $N \cdot s/m^3$(10 $lb/ft^2s$ to 800 $lb/ft^2s$).

7. A sound absorbing panel configured to be provided on a soundproof panel comprising:

an outer frame body having therein an acoustic space in which a first acoustic material is provided, the outer frame body includes a front surface portion at a front side and a back surface portion, each of the front surface portion and the back surface portion includes through holes; and a second acoustic material provided on an upper end of the outer frame body, wherein a peripheral surface of the second acoustic material except for a corner portion of an upper end edge at the front side is covered by an air-permeable member, and a reinforcement portion is provided only at the corner portion.

8. The sound absorbing panel according to claim 7, wherein the first acoustic material and the second acoustic material are formed of a porous material made of polyester fiber wool.

9. The sound absorbing panel according to claim 7, wherein surface densities of the first acoustic material and the second acoustic material are set at 0.6 to 100 $kg/m^2$(0.1 to 20 $lb/ft^2$), and flow resistance values thereof are set at 50 to 4000 $N \cdot s/m^3$(10 $lb/ft^2s$ to 800 $lb/ft^2s$).

10. The sound absorbing panel according to claim 7, wherein the air-permeable member is a porous surface body, and the porous surface body is one selected from punching metal, a wire net, cloth, and a metallic sintered material.

11. A soundproof wall equipment comprising:

the sound absorbing panel according to claim 7; and the soundproof panel on which the sound absorbing panel is provided.

12. The soundproof wall equipment according to claim 11, wherein the soundproof panel is arranged on another soundproof panel arranged in a vertical direction.

* * * * *